United States Patent [19]

Dorsey, Jr.

[11] 4,004,951

[45] Jan. 25, 1977

[54] PROTECTIVE COATING FOR ALUMINUM PRODUCTS

[75] Inventor: Geoffrey A. Dorsey, Jr., Danville, Calif.

[73] Assignee: Kaiser Aluminum & Chemical Corporation, Oakland, Calif.

[22] Filed: Sept. 8, 1975

[21] Appl. No.: 610,966

Related U.S. Application Data

[63] Continuation-in-part of Ser. No. 593,092, July 3, 1975, abandoned.

[52] U.S. Cl. ..... 148/6.27; 427/309; 427/337; 427/435; 428/470

[51] Int. Cl.[2] ..... C23F 7/00

[58] Field of Search ..... 148/6.27; 427/435, 309, 427/337; 428/470

[56] References Cited

UNITED STATES PATENTS

| | | | |
|---|---|---|---|
| 2,107,288 | 2/1938 | Curran | 148/6.27 |
| 2,230,273 | 2/1941 | Smith | 428/470 |
| 2,963,391 | 12/1960 | Kubie | 148/6.14 |
| 3,228,866 | 1/1966 | Pryor | 204/290 X |

*Primary Examiner*—Ralph S. Kendall

*Attorney, Agent, or Firm*—Paul E. Calrow; Edward J. Lynch

[57] ABSTRACT

This invention relates to the formation of a hydrophobic and usually oleophilic coating on an aluminum surface by treating the aluminum surface with an aqueous alkaline solution containing long chain aliphatic carboxylic acids, alkali metal salts or ammonium salts of such acids or other long chain aliphatic compounds which generate a long chain carboxylate anion in an alkaline solution.

18 Claims, No Drawings

PROTECTIVE COATING FOR ALUMINUM PRODUCTS

RELATED APPLICATIONS

The application is a continuation-in-part of application Ser. No. 593,092 filed July 3, 1975 now abandoned.

BACKGROUND OF THE INVENTION

This invention is directed to a simple method of forming a hydrophobic coating on an aluminum surface.

Many processes are presently available for coating aluminum surfaces, such as anodizing, plating, chemical conversion coatings, painting and the like. The coatings, although designed for long life, require extensive surface pretreatments and are quite expensive. However, frequently, only short-term protection is need or desired, for example, in shipping or storing semi-fabricated aluminum products, such as coiled sheet and the like, to prevent the formation of water stain or other oxidation products. On other occasions, it is desirable to prevent the gradual buildup of natural oxide on the aluminum surface, for example, in welding applications and adhesive bonding applications because the buildup of natural oxide can interfere with these types of operations. However, no simple and inexpensive process is presently known which will give short-term protection without interfering with subsequent fabrication or surface treatments, particularly when lubricants must be applied to the surface.

A simple, inexpensive process for coating aluminum is described by Wittrock et al. in U.S. Pat. No. 3,726,721, assigned to the present assignee, but the friable coating formed by this process can interfere with subsequent forming or coating operations.

Kubie in U.S. Pat. No. 2,963,391 describes a process for forming a coating designed as an extrusion lubricant wherein the aluminum surface is first treated with an ammonia-laden alkaline solution containing a fatty acid (or equivalent salt or ester thereof) and then baked at about 400° F to form a coating having unknown properties except for lubrication.

Marosi in U.S. Pat. No. 3,849,207 describes and claims a process for treating aluminum and other metals wherein the surface is treated with an alkaline sodium formate solution and then coated with a clear resinous film to form a sepia-colored coating. The nature of the coating formed during treatment in the alkaline sodium formate solution is not described in the reference. However, it has been found that the aluminum surface underlying such a coating is susceptible to water stain or other oxidation in much the same manner as untreated aluminum because the coating is readily wet and penetrated by water or aqueous solutions.

A simple, inexpensive method to temporarily prevent extensive oxidation of an aluminum surface by water or other media particularly in coiled sheet has been needed for many years, but has been heretofore unavailable.

It is against this background that the present invention was developed.

DESCRIPTION OF THE INVENTION

The invention generally relates to the coating of an aluminum surface and particularly to the treatment of an aluminum surface to form a tenacious hydrophobic coating which protects the underlying aluminum surface from oxidation and also facilitates the application of lubricant for subsequent fabrication. As used herein, aluminum refers to pure aluminum, commercially pure aluminum and aluminum alloys.

In accordance with the invention, an aluminum surface is treated with an aqueous alkaline solution containing a long chain aliphatic carboxylic acid, an equivalent alkali metal salt thereof or a compound which generates a long chain aliphatic carboxylate anion in an alkaline solution at elevated temperatures greater than 60° C. Treatment times usually will be about one second for a clean surface, but extended treatment times do not seem to detrimentally affect the coating. The surface coating is hydrophobic and usually highly oleophilic. Moreover, the coating is not usually affected by mineral acids, such as nitric acid, hydrochloric acid or sulfuric acid or by common polar solvents, such as acetone or ethyl alcohol. The coating formed is very difficult to analyze because under most circumstances, it appears to be a monomolecular layer on the order of 100 A thick. The carboxylate anion generating compound in the alkaline solution is apparently either reacting with the aluminum surface to form a type of aluminum soap or at least strongly associating with the aluminum surface.

The pH of the alkaline treating solution must be from about 8.5 to about 10.0, preferably about 9–10. At a pH much above 10, no coating occurs, only etching. The temperature at the interface between the metal and the bath should exceed 60° C and preferably should be from about 75° C to the boiling point of the solution. For optimum results, the temperature is maintained at about 85° ± 5° C. Although generally it will be most convenient to treat the aluminum surface with a solution maintained at the prescribed temperature, it is contemplated to treat an aluminum workpiece heated well above the prescribed temperature with a solution at less than the prescribed temperature to effect the required interface temperatures. No significant coating formation is found at interface temperatures much below 60° C.

The long chain aliphatic compound in the treatment bath need only be present in small quantities, usually greater than 1 part per million by weight. However, it is preferred to maintain the compound in a slight excess of saturation to form an emulsion for the convenience of composition control. The compound can be a long chain aliphatic carboxylic acid (a fatty acid), an alkali metal salt or ammonium salt or ammonium salt thereof or other compounds which generate a long chain carboxylate anion in an alkaline solution. The long chain carboxylate anion should have from 10–20 carbon atoms, preferably 12–18. Below 10 carbon atoms, the coatings are not sufficiently hydrophobic to be of any value in preventing the wetting of the coating and the penetration thereof by water or other aqueous solutions which leads to water stain. Compounds with more than 20 carbon atoms in the chain usually just coat the aluminum surface and neither react with nor strongly associate with the aluminum substrate. This latter feature is readily shown by removing the coating with polar solvents, such as acetone or ethyl alcohol. Additionally, excessively long chain carboxylate components are usually too difficult to maintain as an emulsion to be effective for treating the surface.

Suitable long chain aliphatic carboxylic acids include lauric acid, myristic acid, palmitic acid, stearic acid, oleic acid, ricinoleic acid, linoleic acid, arachidic acid and the like. Preferably, alkali metal salts of the above acids are used. Although the sodium and potassium salts are most desirable in the present invention, lithium, cesium and ammonium salts are functional. Other compounds which generate the appropriate carboxylate anion in an alkaline solution can also be used. The aliphatic component of the carboxylate generating compound can be saturated or unsaturated; however, unsaturated compounds tend to be less effective than saturated compounds. Substitutions on the aliphatic carbon chain can be made provided they do not prevent the carboxylate compound from forming the desired coating.

If desired, wetting agents, such as Emsorb 6903 (sold by Emery Industries, Inc.), Tween 85 (sold by ICI American, Inc.) and Ultrawet (sold by the Armour and Company) can be added to the solution in amount up to 3% by weight to facilitate the wetting of the aluminum surface by the alkaline solution during treatment. Use of wetting agents tends to render the coating more oleophilic. Other components, such as emulsifiers and the like, can be added up to 3% by weight to render the fatty acid component miscible or at least emulsifiable with the aqueous solution. Mechanical dispersions can also be employed, for example, when the emulsification of the carboxylate generating component in the alkaline solution is difficult.

The treatment solution may be rendered alkaline by the addition of appropriate saponifying agents, such as an alkali metal hydroxide or ammonium hydroxide. However, in many instances, such as when utilizing sodium stearate or sodium palmitate, the solution will be sufficiently alkaline so that additional hydroxide additions become unnecessary. Although ammonium salts and ammonium hydroxide can be employed in the alkaline treatment solution, these compounds are not particularly desirable because at the required elevated interface temperatures, ammonia is driven from the solution rendering the maintenance of a suitably alkaline pH at the interface very difficult.

When the aluminum surface is first contacted by the alkaline solution of the invention, an initial, very short burst of effervescence occurs indicating that the aluminum substrate is being etched. The effervescence quickly subsides, however, and the desired hydrophobic coating forms, usually within a few seconds. A heavy oxide layer can retard coating formation and apparently most, if not all, of oxide coating must be etched away before any reaction or strong association can occur between the carboxylate anion and the aluminum substrate. The etching which occurs initially may leave or generate a very thin layer of oxide on the metal surface, and in all likelihood, the carboxylate anion may be reacting with basic sites on this thin oxide coating to form the soap.

The surface coating which forms in the invention is neither readily wet nor penetrated by water or other nonalkaline aqueous solutions. The surface is usually oleophilic and is generally compatible with most, if not all, metal-working lubricants including water-based emulsions. This compatibility of the coating with lubricants is enhanced considerably by the use of wetting agents in the alkaline treating solution and particularly by treating the formed hydrophobic coating with a hot (greater than 60° C) alkaline solution (pH 8.5–10, preferably 9.0–10.0) of a wetting agent. Nonionic and cationic wetting agents are preferred.

The hydrophobic coating has an electrical resistance initially of about 15 micro-ohms per $cm^2$ which remains relatively stable for at least 2–3 weeks. This indicates that essentially no oxidation of the underlying aluminum surface is occurring. These resistance levels are to be compared with a natural oxide coating which has an initial resistance of about 30 micro-ohms per $cm^2$ and which can gradually increase to well over 1,000 micro-ohms per $cm^2$ in a matter of days. The relatively stable resistance exhibited by the coating of the invention is a very advantageous feature. For example, in welding aluminum, the oxide coating is not desirable because it interferes with the welding operation, particularly spot resistance welding. By maintaining the resistance at a relatively constant level, there is no need to clean the surface prior to welding.

Moreover, in manufacturing facilities utilizing the adhesive bonding of aluminum components, the coating of the invention prevents oxidation during the various fabrication or assembly procedures, yet it provides an excellent foundation for adhesion between the aluminum substrate and other materials.

The coating of the invention can be readily removed by treatment with alkaline cleaning solutions normally employed to industrially clean aluminum surfaces prior to various surface treatments, such as anodizing, painting and the like.

It has also been found that the process of the invention can be employed to treat aluminum surfaces which are oxidized or otherwise contaminated with oxidized products prior to subsequent fabrication. The etching which occurs in the process removes the contaminated oxide surface and the coating formed is readily compatible with and wet by metal-working lubricants. For example, the surface of aluminum alloy sheet used for making drawn and ironed can bodies is frequently contaminated with water stain (oxidation product from the condensation of water on the surface during transporting or storing) or pick-up (highly oxidized metal particles embedded in the surface during rolling), which interfere with the drawing and ironing operations. By treating such sheet in accordance with the invention, the etching removes substantially all of the oxidized surface contaminants. The coating formed readily accepts the draw and iron lubricant, particularly when subsequently treated with a hot alkaline solution containing a wetting agent. Treatment times with heavy natural oxide coatings which have been aged tend to be in the order of several minutes rather than a few seconds as when a fresh natural oxide-coated aluminum surface is treated.

The following examples are given to further illustrate the invention.

In each of the Examples 1–7, a clean 3004-H19 aluminum alloy sheet was treated. The treating solutions, which were maintained at 85° ± 5° C, were prepared by adding 1.0 gram/liter of the noted acid to deionized or distilled water and then adjusting the pH to 9.0 ± 0.1 with NaOH if needed. Treatment time in each case was 30 seconds. Each treated specimen was checked for water wettability after treatment in the alkaline solution, after a 30-second dip in a 35% (by weight) nitric acid solution and then after an acetone-ethyl alcohol rinse.

EXAMPLE 1

Lauric acid (C-12) formed a hydrophobic, oleophilic surface which remained hydrophobic after a 30-second dip in the nitric acid. However, after the nitric acid treatment, the acetone-ethyl alcohol rinse apparently removed the hydrophobic coating because the treated surface could then be wet with water.

EXAMPLE 2

Myristic acid (C-14) formed a hydrophobic, oleophilic surface which remained hydrophobic after a 30-second dip in the nitric acid. However, after the nitric acid treatment, the acetone-ethyl alcohol solution apparently removed the hydrophobic coating because the treated surface could then be wet with water.

EXAMPLE 3

Palmitic acid (C-16) formed a hydrophobic, oleophilic surface which remained so after both the nitric acid dip and the acetone-ethyl alcohol rinse.

EXAMPLE 4

Stearic acid (C-18) formed a hydrophobic, oleophilic surface which remained so after both the nitric acid dip and the acetone-ethyl alcohol rinse.

EXAMPLE 5

Oleic acid (unsaturated C-18) formed a hydrophobic, oleophilic surface which remained hydrophobic after a 30-second dip in the nitric acid. However, after the nitric acid treatment, the acetone-ethyl alcohol solution apparently removed the hydrophobic coating because the treated surface could then be wet with water.

EXAMPLE 6

Linoleic acid (unsaturated C-18) formed a hydrophobic, oleophilic surface which remained hydrophobic after a 30-second dip in the nitric acid. However, after the nitric acid treatment, the acetone-ethyl alcohol solution apparently removed the coating because the treated surface could then be wet with water.

EXAMPLE 7

Arachidic acid (C-20) formed a hydrophobic, oleophilic surface but after the nitric acid dip, the surface became hydrophilic.

EXAMPLE 8

A clean 3004-H32 aluminum alloy sheet was treated for 5 seconds in an aqueous alkaline solution maintained at 80° C which contained 1.0 gram/liter sodium stearate. The pH of the solution was 9.3. Initially, a burst of effervescence occurred but the effervescence quickly subsided and the desired hydrophobic, oleophilic coating formed. The treated sheet withstood 20 hours of continuous water-fog exposure with no evidence of water stain or other surface defects. The coating was fully compatible with various metal-working lubricants, such as are used in rolling, forging, drawing and ironing, shaping, stamping and the like. Initially, the treated surface had an electrical resistance of 16 micro-ohms/cm$^2$ and after 6 weeks of laboratory expsoure (23° C and 70% humidity) had an electrical resistance of only 30 micro-ohms/cm$^2$.

EXAMPLE 9

A steel sheet was treated in accordance with the conditions set forth above the Examples 1–7. However, no significant coating formation was noted. The surface of the ferrous product was readily wet by water after treatment. There was some evidence (discoloration of the solution) that the solution was merely dissolving the surface.

EXAMPLE 10

A plurality of clean, closely packed 3004-H32 aluminum sheets were treated in the manner set forth above in Example 8 except that 2.0 grams/liter of a polyoxyethylene sorbitan trioleate sold under the brand name Tween 85 was added to the solution as a wetting agent. The coating formed was fully equivalent to the coating formed in Example 8. The wetting agent allowed the solution to penetrate in between closely packed aluminum sheet and react with the surfaces thereof.

EXAMPLE 11

A 3004-H32 aluminum alloy sheet was treated with a solution containing a polyoxyethylene sorbitan trioleate alone (Tween 85) as the source for carboxylate anions. The solution which contained 2 grams/liter of the trioleate (Tween 85) was at a pH of 9.5 and a temperature of 80° C. The coating formed was hydrophobic and oleophilic.

EXAMPLE 12

Clean 3004-H32 aluminum alloy sheets were treated for 30 seconds in a hot aqueous alkaline solution containing 1 gram/liter of sodium stearate. The pH of the solution was 9.5 and the temperature was 80° C. After treatment, the sheets were rinsed and then separate sheets were treated for 5, 15, 25 and 35 seconds in a second hot, aqueous alkaline solution containing 2 grams/liter of a polyoxyethylene sorbitan trioleate (Tween 85). The pH and temperature of the second solution were also 9.5 and 80° C, respectively. The coatings formed were hydrophobic and highly oleophilic. Treated sheets were then evaluated for compatibility with mineral oil. The evaluation was conducted by placing a drop of mineral oil on a treated surface inclined about 70° C from the horizontal and then determining the time required for the drop of oil to travel 3 inches on the inclined surface. Longer times indicate greater wettability and thus greater compatibility with the lubricant. The results are as follows:

| Duration of Second Treatment | Time, sec. |
|---|---|
| 0 | 8–10 |
| 5 | 25–35 |
| 15 | 60 |
| 25 | 90 |
| 35 | 90 |

Similar results were obtained with a drop of a 30% by volume oil-in-water emulsion of Texaca 591, a common aluminum metal-working lubricant.

In other tests, C-8 acids, such as caprylic acid, and C-22 acids, such as behenic acid, were found to form hydrophilic coating.

It is obvious that various modifications and improvements can be made to the invention described herein without departing from the spirit thereof and the scope of the appended claims.

What is claimed is:

1. A method of forming a tenacious, hydrophobic coating on an aluminum surface which is resistant to polar organic solvents comprising treating the aluminum surface with an alkaline solution at a pH less than 10 containing a compound which generates therein a long chain aliphatic carboxylate anion having from 10–20 carbon atoms and maintaining the temperature at the surface-solution interface greater than 60° C, the solution initially etching the aluminum surface and then the solution forming aa tenacious hydrophobic coating on the aluminum surface which is resistant to polar organic solvents.

2. The method of claim 1 wherein the treatment solution is at a temperature from about 75° C to the boiling point of the solution.

3. The method of claim 1 wherein said compound is selected from the group consisting of long chain aliphatic carboxylic acids and alkali metal salts or ammonium salts of long chain aliphatic carboxylic acids.

4. The method of claim 1 wherein the treatment solution is at a temperature from about 80° to about 90° C.

5. The method of claim 1 wherein the pH of the solution is maintained greater than 8.5.

6. The method of claim 1 wherein the pH of the solution is from about 9–10.

7. The method of claim 1 wherein the solution contains more than 1 part per million of said carboxylate anion generating compound.

8. The method of claim 1 wherein the alkaline solution contains a wetting agent to facilitate the wetting of the untreated aluminum surface with the alkaline solution.

9. The method of claim 1 wherein said compound is sodium stearate.

10. The method of claim 3 wherein said alkali metal salts are selected from the group consisting of sodium and potassium salts.

11. The method of claim 1 wherein said solution is maintained alkaline by the addition of an alkali metal hydroxide.

12. The method of claim 1 wherein said coating is less than 100 angstrom units thick.

13. The method of claim 1 wherein the carboxylate anion generating compound has from 12–18 carbon atoms in the carbon chain.

14. An aluminum product having a hydrophobic coating formed by the process of claim 1.

15. The method of claim 1 wherein the hydrophobic coating is further treated with an alkaline solution containing a wetting agent at a temperature greater than 60° C.

16. The method of claim 15 wherein the pH of the solution containing the wetting agent ranges from about 8.5–10.0.

17. The method of claim 16 wherein the pH ranges from about 9.0–10.0.

18. The aluminum product having a coating formed by the process of claim 15.

* * * * *